US009833644B2

(12) United States Patent
Hansel et al.

(10) Patent No.: US 9,833,644 B2
(45) Date of Patent: Dec. 5, 2017

(54) AIR PURIFICATION RESPIRATOR VOICE AMPLIFIER

(71) Applicant: Undersea Sensor Systems, Inc., Columbia City, IN (US)

(72) Inventors: Thomas J Hansel, Fort Wayne, IN (US); Christopher G Ziel, Fort Wayne, IN (US); David A Schnellbach, Wolcottville, IN (US)

(73) Assignee: Undersea Sensor Systems, Inc., Columbia City, IN (US)

( * ) Notice: Subject to any disclaimer, the term of this patent is extended or adjusted under 35 U.S.C. 154(b) by 481 days.

(21) Appl. No.: 14/476,395

(22) Filed: Sep. 3, 2014

(65) Prior Publication Data

US 2016/0059051 A1 Mar. 3, 2016

(51) Int. Cl.
*A62B 18/08* (2006.01)

(52) U.S. Cl.
CPC ..... *A62B 18/08* (2013.01)

(58) Field of Classification Search
CPC .. A41G 7/02; A42B 3/30; A62B 18/08; G10L 2021/0135; H04B 1/385; H04B 10/00; H04B 2001/3866; H04R 1/025; H04R 1/083; H04R 1/222; H04R 1/44; H04R 27/00; H04R 5/02; Y10S 2/90
USPC ..... 128/201.19, 201.25, 206.12, 206.17, 128/205.25, 206.16, 207.12; 381/122, 381/344, 367, 376, 385, 75, 79, 87, 361, 381/375, 61; 398/104, 115, 117, 133, 398/154, 156
See application file for complete search history.

(56) References Cited

U.S. PATENT DOCUMENTS

| | | | | |
|---|---|---|---|---|
| 3,314,424 | A | 4/1967 | Berman | |
| 4,471,174 | A | 9/1984 | Nava | |
| 4,736,740 | A | 4/1988 | Parker et al. | |
| 4,901,356 | A | 2/1990 | Bauer | |
| 5,060,308 | A | 10/1991 | Bieback | |
| 5,224,473 | A * | 7/1993 | Bloomfield | A62B 18/08 128/201.19 |
| 5,371,804 | A | 12/1994 | Bauer | |
| 5,463,693 | A | 10/1995 | Birli et al. | |
| 5,503,141 | A | 4/1996 | Kettl et al. | |
| 5,566,362 | A | 10/1996 | Bauer et al. | |
| 5,990,793 | A | 11/1999 | Bieback | |
| 6,382,206 | B1 | 5/2002 | Palazzotto et al. | |
| 6,626,178 | B2 | 9/2003 | Morgan et al. | |
| 7,394,905 | B2 * | 7/2008 | Miller | H04R 1/025 128/201.19 |

(Continued)

OTHER PUBLICATIONS

"Mask-Servicing." Operator's Manual for Mask, Chemical-Biological Field. Headquarters Department of the Army, Oct. 5, 1987. Web. Jan. 7, 2017.*

*Primary Examiner* — Annette Dixon

(57) ABSTRACT

An electrical amplifier unit which removably attaches to a gas mask and includes a microphone for detecting voice sounds emitted by the wearer of the gas mask, circuitry for amplifying the detecting sound, and a loudspeaker for emitting the amplified sounds externally of the mask. The associated components are contained within a housing that attaches sealably to the outlet port of a gas mask. The amplifier unit is quickly and easily attachable to commercially available gas masks without additional hardware and does not affect the structural and functional integrity of the host mask.

23 Claims, 6 Drawing Sheets

(56) References Cited

U.S. PATENT DOCUMENTS

| | | | |
|---|---|---|---|
| 7,457,427 | B2 | 11/2008 | Birli et al. |
| 2003/0224838 | A1 | 12/2003 | Skillicorn et al. |
| 2005/0201548 | A1 | 9/2005 | Birli et al. |
| 2006/0180153 | A1 | 8/2006 | Schaub et al. |

* cited by examiner

AIR PURIFICATION RESPIRATOR VOICE AMPLIFIER

CROSS-REFERENCES TO RELATED APPLICATIONS

Not applicable

STATEMENT REGARDING FEDERALLY SPONSORED RESEARCH OR DEVELOPMENT

Not applicable

BACKGROUND

Air purification respirators ("APRs"), commonly referred to as "gas masks," are in wide private and military use. APRs are wearable filtering devices used to create an envelope of clean air around at least a wearer's nose and mouth, providing protection to the wearer from the inhalation of undesired or harmful dust, fumes, vapors, or other gases.

APRs have multiple applications, particularly in the industrial and military fields. APRs are used in industry to protect workers from airborne industrial hazards such as fumes, gasses, dust, and particulate matter. Representative industrial uses would include in paint booths, grain storage facilities, and laboratories. In the military, APRs are employed to protect personnel who may be exposed to attack by poison gas or other airborne toxins.

APRs are generally manufactured in the form of a mask that covers at least the wearer's mouth and nose. APRs can include additional protective surfaces to guard the wearer's eyes, ears, facial skin, or even hair. When properly fitted and worn by a wearer, an APR creates an envelope of clean air within the APR by, in part, forming a seal between the APR and the wearer's face that substantially prohibits the entry of air from the outside environment. As a result, the air breathed by the wearer during use of the APR is, except for minimal leakage through the facial seal, the intake ports, or the exhalation valve, air that has been cleaned by filters connected to the APR intake ports or air that has been provided directly from a known clean air source such as an air tank.

APRs generally have one or more intake ports, usually disposed towards the sides of the mask apparatus. A filter apparatus or canister can be fitted into the intake port, usually by a sealing threaded connection or a sealing press-fit connection. Both filter ports can be fitted with filter apparatuses, or one can be so fitted and the other sealed shut with a threaded cap. This general modularity allows filters to be changed quickly and conveniently, and allows different filtering apparatus to be installed to optimize an APR for different environments. The ability to quickly replace filters also reduces cost by allowing the same APR mask body to be re-used even if the filters have to be replaced or changed. Alternatively, one or both intake ports can be coupled to a hose leading to a known clean air source, such as an air take.

APRs generally include a means to allow the wearer's exhaled breath to escape, most typically an outlet port disposed on a central portion of the mask. The outlet port of the APR typically comprises a port, generally round in shape, disposed over the area of the wearer's mouth. In many APRs in common use, this port includes one-way valve assembly, such as a flap valve, configured to allow air to escape from the APR during the wearer's exhalation, but which prevents air from the outside environment from entering the APR during inhalation. This one-way valve assembly is often removable via a sealing snap-on or sealing interference fit with the lip of the outlet port of the APR. In one common configuration, the outlet port of the APR includes a spoke-and-hub structures in which spokes support a donut-shaped hub in the center of the port opening. The hole in the center of the hub is sized to accept the stem of a mushroom-style membrane, which stem presses into the hole in the center of the hub and is there retained, with the membrane in general contact with the spokes of the spoke-and-hub structure and in generally sealed contact with a circumferential rim around the edge of the outlet port. The membrane is shaped and sized to cover the outlet port opening and a portion of this circumferential rim. When a wearer exhales, exhalation pushes the membrane away from the spoke-and-hub structure and from the rim, allowing the exhaled air to escape through the exhalation port. At other times, and particularly when a wearer inhales, the membrane is pulled by negative pressure against the spoke-and-hub structure and the circumferential rim, sealing the outlet port so that air from the outside environment (other than leakage in acceptable volumes, as would be known by one skilled in the art) does not enter the clean air envelope defined by the mask.

APRs may be either positive pressure or negative pressure devices. A positive pressure APR typically includes an external pump or pressurized vessel that forces clean air into the APR through an intake port. Positive pressure creates a more positively sealed clean air envelope, since the pressure within the clean air envelope is higher than the pressure of the external air. Such positive pressure reduces the occurrence of seepage or leakage of air from the outside environment into the clean air envelope of the APR.

A negative pressure APR is more common and less expensive, and uses the negative pressure generated by the wearer's inhalation to assist with sealing the APR to the wearer's face. A wearer's inhalation generates negative pressure inside the clean air envelope as it draws air into the APR through the intake ports. Filter apparatus attached to the intake ports clean air from the outside environment before it passes into the clean air envelope. The negative pressure generated by inhalation assists with maintaining the seal between the APR and the wearer's face and assists with maintaining the seal formed by the outlet port valve.

One disadvantage common to APRs is impairment of the wearer's ability to speak clearly or audibly. Maintenance of a clean air envelope within the APR restricts the volume of air going into or out of the APR. Even exhaled air must pass through a one-way valve before it reaches the outside environment. As a result, the volume of sound generated by a wearer's speech or other vocalizations is notably diminished to listeners, and such vocalizations may be garbled and difficult to understand. This impairment to clear and audible speech is a detriment in many of the APRs typical applications, particularly in military and industrial contexts where clear and audible communication may be imperative.

Several attempts to mitigate this impairment to a wearer's ability to speak and be heard clearly while wearing an APR are known to the art. Some APRs are equipped with a diaphragm element in proximity to the outlet port that acts as a mechanical emitter to more efficiently transmit vibrations created by the wearer's speech from the clean air envelope within the APR to the outside environment without allowing untreated air to pass into the APR. While diaphragms facilitate some improvement in sound transmission, they still result in speech that is largely muted, muffled, and difficult to understand.

Alternate attempts to solve this problem are disclosed by, for example, U.S. Pat. No. 5,463,693. These solutions involve amplifiers, microphones, or both, adapted to fit either on the outlet or inlet port of an APR (externally mounted solutions) or within the clean air envelope (internally mounted solutions). These known solutions generally require substantial modification of the APR, which is a disadvantage if clear vocalization is desired as an optional, but not a mandatory feature, for the APR. The modification to the APR required by these solutions also risks compromise of the integrity of the clean air envelope seal and does not allow a standard APR to be adapted quickly to allow improved vocal transmission. Further, since externally mounted solutions attempt generally to amplify sound transmitted through the APR, they still result in muted and muffled speech. Internally mounted solutions also often require piercing of components of the APR for the passage of wires or other structures, threatening the integrity of the clean air envelope.

It would be a decided advantage to have an enhanced speech transmission device that can be readily attached to an existing APR produced in large quantities, which places a microphone inside of the wearer's clean air envelope, but does not require piercing any portion of the APR, does not require substantial modification of the APR, and enables the wearer to transmit clear speech without substantial muting or muffling.

SUMMARY

Versions of the present invention are directed to an enhanced speech transmission device that can be readily attached to commonly-used APRs. Versions of the present invention are further directed to an enhanced speech transmission APR device. Versions of the present invention are further directed to methods of improving the audibility of the speech of an APR wearer. The present invention satisfies the need for a device that substantially enhances the volume and clarity of the speech of the wearer of an APR and can easily and quickly be attached to or removed from an APR without tools, without substantial modification of the APR, and without piercing any portion of the APR.

BRIEF DESCRIPTION OF THE DRAWINGS

These and other features, aspects, and advantages of the present invention will become better understood with regard to the following description and accompanying drawings, where.

DETAILED DESCRIPTION

Figure 1:
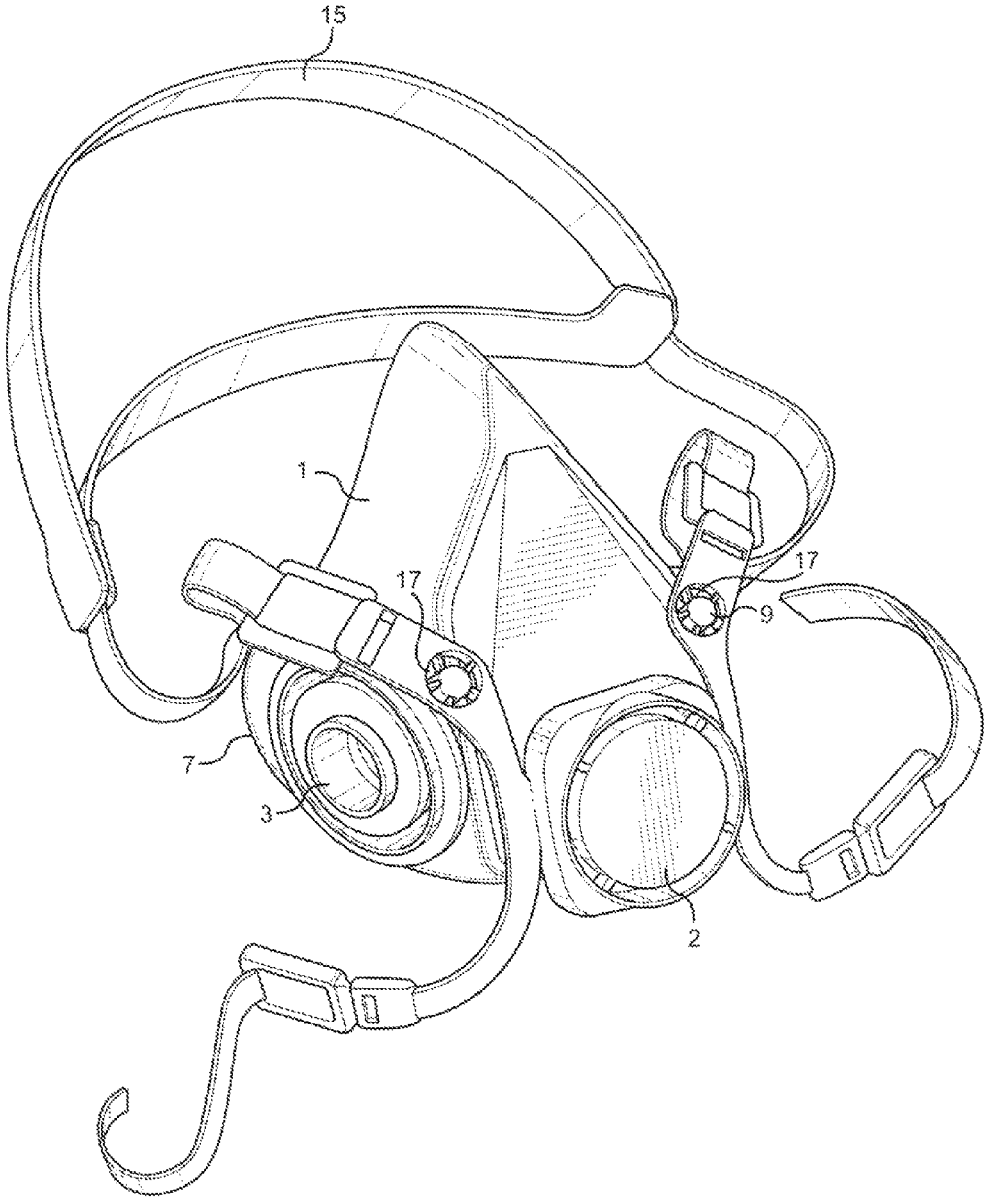
FIG. 1 shows a perspective view of a commonly-used APR suited for modification by an enhanced speech transmission device as described herein.
Figure 2:
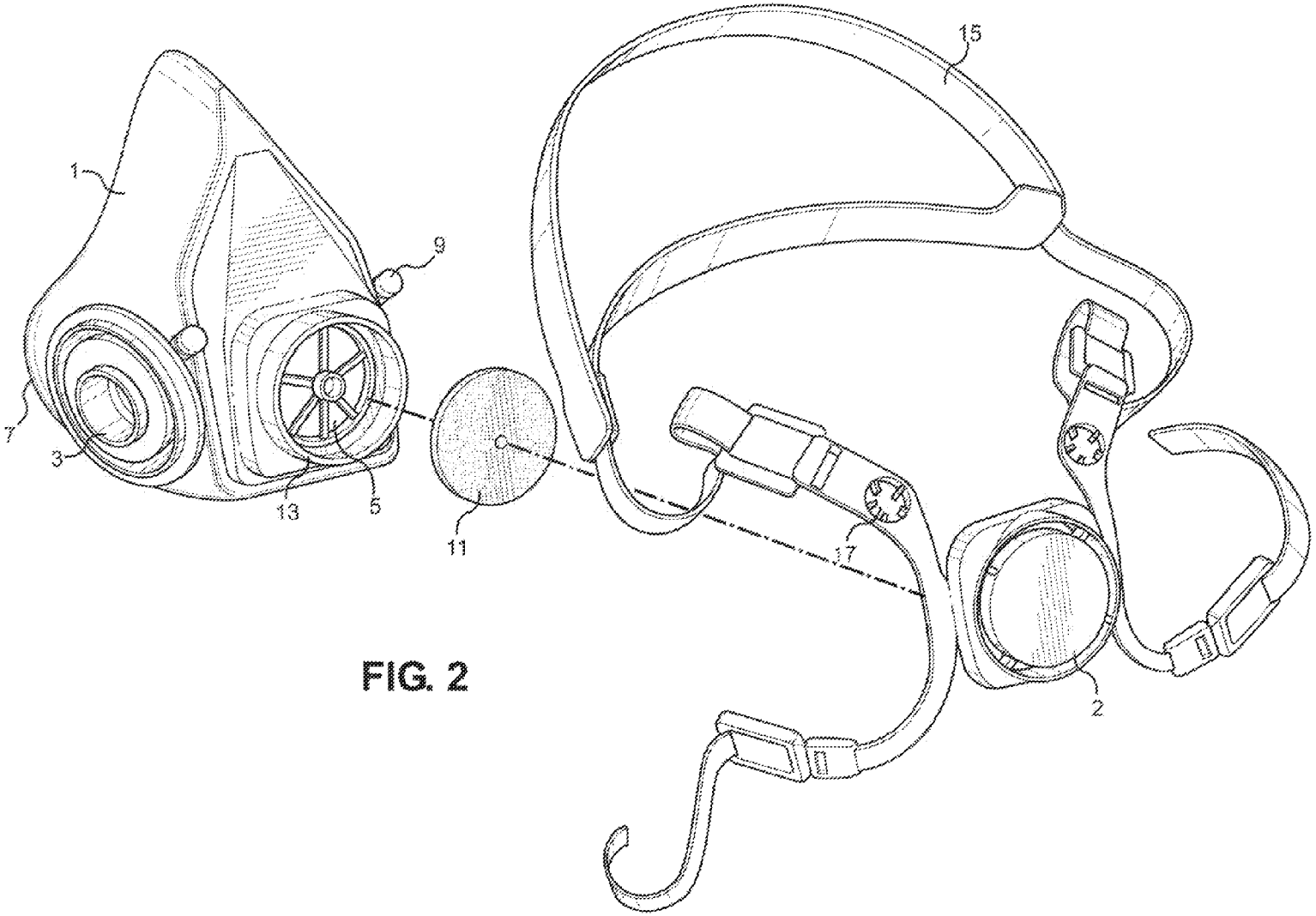
FIG. 2 shows an exploded view of a commonly-used APR suited for modification by an enhanced speech transmission device as described herein.

Referring now to the specific embodiments shown above, FIGS. 1 and 2 show one commonly-used APR known to the art. In relevant part, this configuration of APR comprises a mask body (1), one or more APR intake ports (3), and an outlet port (5). The mask body (1) further comprises a gasket (7) shaped to seal to a wearer's face, and attachment pins (9). The APR outlet port includes an APR valve portion (11), in this case a mushroom-style valve membrane coupled to the hub-and-spoke structure within the APR outlet port (5) of the APR. In the embodiment shown in FIG. 1, the outlet port (3) has a generally round protruding lip (13) to which a cover (2) can be attached, generally through a press fit. A typical APR further comprises a retaining member (15) that assists with keeping the APR in sealed connection with the wearer's face. In the APR shown in FIG. 1, the retaining member (15) is a strap configured to wrap around the back of the wearer's head on one side, and, on the other side, connects to the APR through one or more attachment points (17) that attach to the APR attachment pins (9). It will be understood by one skilled in the art that while one form of commonly used APR is shown, the invention herein is not limited to the depicted APR and can be used with a variety of makes and types of APRs in a variety of configurations, including full masks, positive pressure APRs, APRs in other configurations, and APRs with other outlet port shapes or exhalation valve types.

Figure 3:
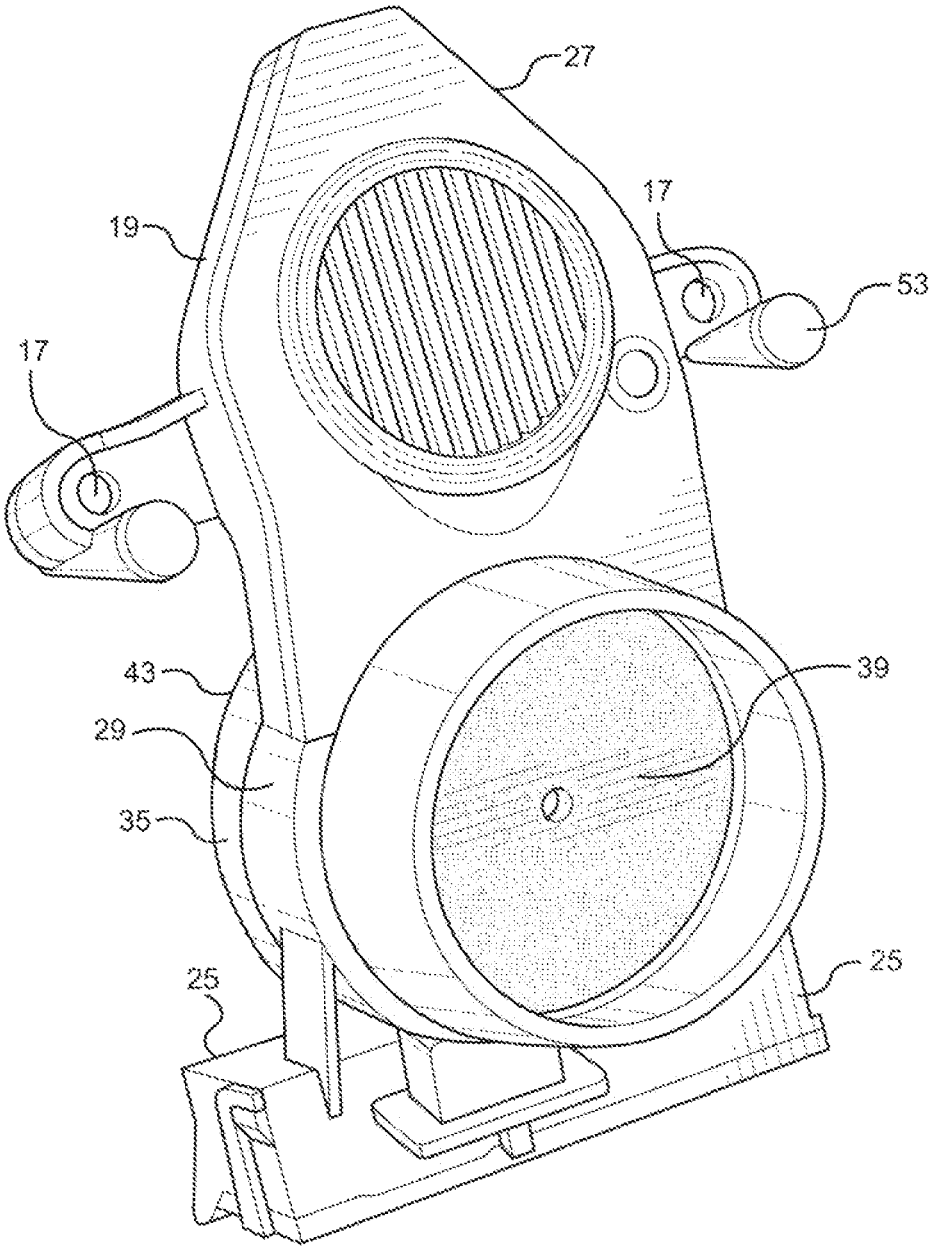
FIG. 3 shows a perspective view of one embodiment of an enhanced speech transmission device as described herein.
Figure 4:
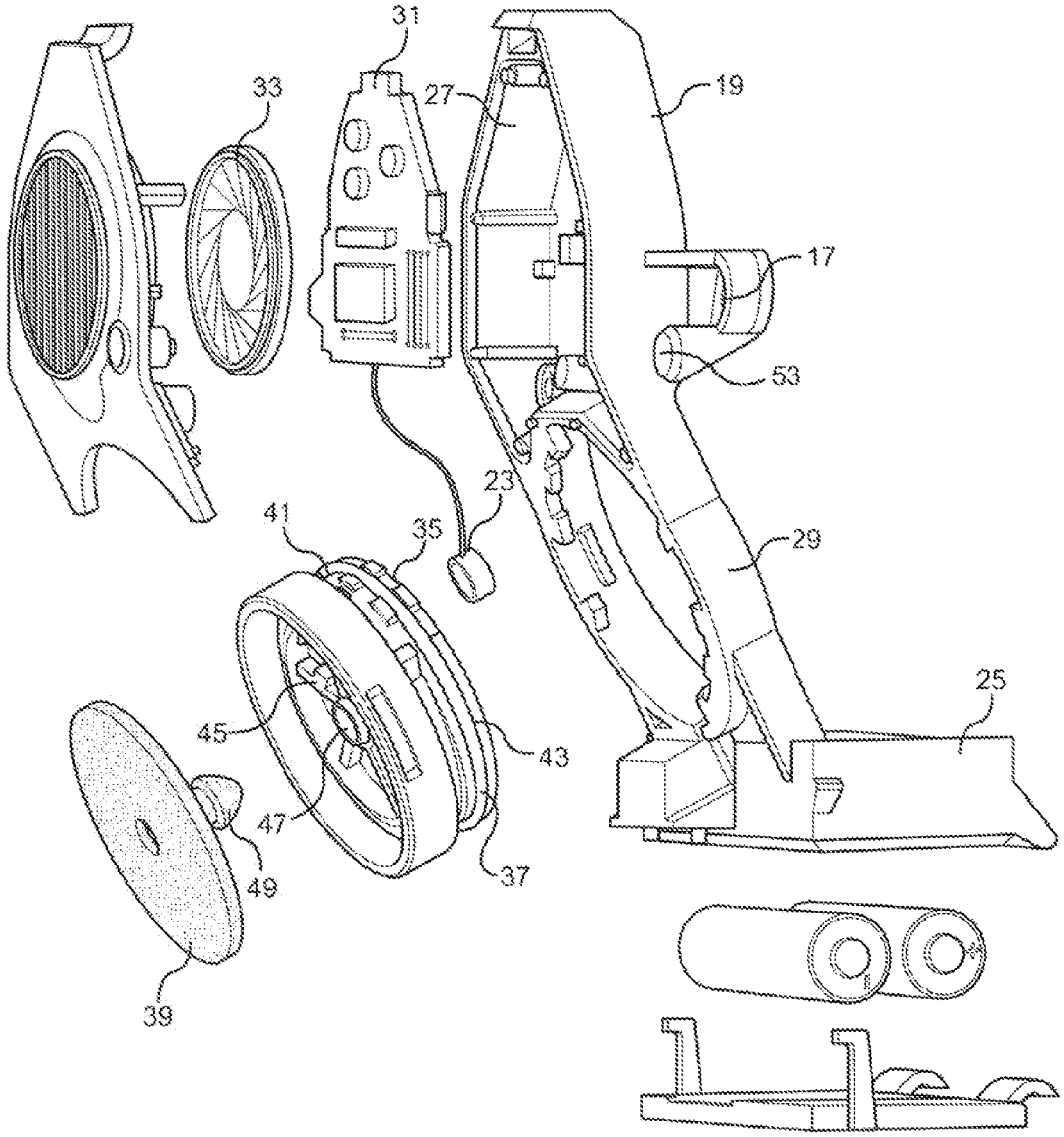
FIG. 4 shows an exploded view of one embodiment of an enhanced speech transmission device as described herein.

Referring now to FIGS. 3 and 4, the enhanced speech transmission device of this invention comprises a main housing (19), an amplifier assembly (21), and a microphone (23). The main housing (19) comprises a battery housing portion (25), an amplifier housing portion (27), and an outlet port portion (29).

The battery housing portion (25) comprises positive and negative connectors for an electric power supply. These connectors are operatively connected, such as through insulated wires, to the amplifier assembly (21). In the preferred embodiment depicted in FIGS. 3 and 4, the power supply is two AAA size alkaline batteries, the battery housing portion (25) is shaped to house and secure those batteries, and the positive and negative connectors are metal tabs configured to operatively connect to the positive and negative terminals, respectively, of those batteries. In this preferred embodiment, the positive and negative connectors are operatively connected to at least the amplifier assembly by insulated wires. It will be appreciated by one skilled in the art that different battery sizes, different battery types, different battery configurations, different numbers of battery, and power sources other than alkaline batteries all may be used within the spirit and scope of this invention. It will be further appreciated by one skilled in the art that the device could be powered by a power source remote from the device.

The main housing (19) further comprises an amplifier housing portion (27). In the preferred embodiment depicted in FIGS. 3 and 4, the amplifier housing portion (27) houses an amplifier assembly that includes at least one amplifier circuit board (31). The amplifier housing portion (27), in this preferred embodiment, further houses at least one speaker (33). Optionally, the amplifier housing portion (27) may comprise a grill or mesh to more easily allow the transmission of sound from the speaker (33) to the outside environment. In the preferred embodiment shown in FIGS. 3 and 5 herein, the amplifier housing portion (27) is located above the outlet port portion (29). It will be appreciated by one skilled in the art that the amplifier housing portion (27) may assume a large variety of shapes and sizes other than those depicted in the preferred embodiment discussed herein. It will further be appreciated that the amplifier housing portion (27) may house an amplifier assembly and one or more speakers (33), may house only the amplifier assembly with all speakers (33) located outside of the amplifier housing portion (27), or may house an amplifier assembly and one or more speakers (33), with additional speakers (33) located outside of the amplifier housing portion (27). It will further be appreciated by one skilled in the art that the amplifier housing portion (27) is not limited to a specific location on the device, and may be placed in a large number of configurations with respect to the outlet port portion (29) and the battery housing portion (25).

The main housing (19) further comprises an outlet port portion (29). The outlet port portion (29) comprises an extension body (35), a sealing member (37), a valve portion (39), and an aperture (41).

Referring to the preferred embodiment shown in FIGS. 3 and 4, the outlet port portion (29) is a structure that generally corresponds to and extends the outlet port (5) of the APR. In this embodiment, the outlet port portion (29) is generally round. It will be appreciated by one skilled in the art that virtually any overall shape, size, or configuration of outlet port portion (29) may be used, so long as it couples to the outlet port (5) of an APR and includes, either integrally or by coupling, a valve portion (39) permitting exhalation.

The outlet port portion (29) further comprises an extension body (35). The extension body (35) has a first portion (43) that is shaped to form a removable sealing connection to the outlet port (5) of an APR, preferably after the valve (11) has been removed from the outlet port (5) of an APR. A sealing member (37) located on, and preferably circumscribing, the first portion (43) cooperates with the outlet port (5) of an APR to seal the connection between the outlet port portion (29) and the outlet port (5) of an APR. In the preferred embodiment shown in FIGS. 4 and 6, the outlet port first portion (43) has a generally round profile corresponding to the generally round outlet port lip (13) of the outlet port (5) of an APR, the sealing member (37) is a gasket around the outer circumference of the first portion (43), and the first portion (43) forms a removable sealing connection to the round outlet port lip (13) of the outlet port (5) of an APR when the first portion (43) is pressed onto the outlet port lip (13) until the sealing member (37) engages the inner circumference of the outlet port lip (13). In a most preferred embodiment, tabs in the outlet portion (29) cooperate with recesses in the outlet port (5) of an APR to create an interference fit between the outlet port (5) of the APR and the device outlet portion (29) to assist with maintaining a sealed connection between the APR and the amplifier. The first portion (43) can have a variety of shapes and sizes, and can couple to the outlet port (5) of an APR in a variety of fashions within the scope and spirit of this invention, as will be appreciated by one skilled in the art, including through a press-on fit, a twist-in fit, a threaded fit, or an interference fit.

Figure 6:
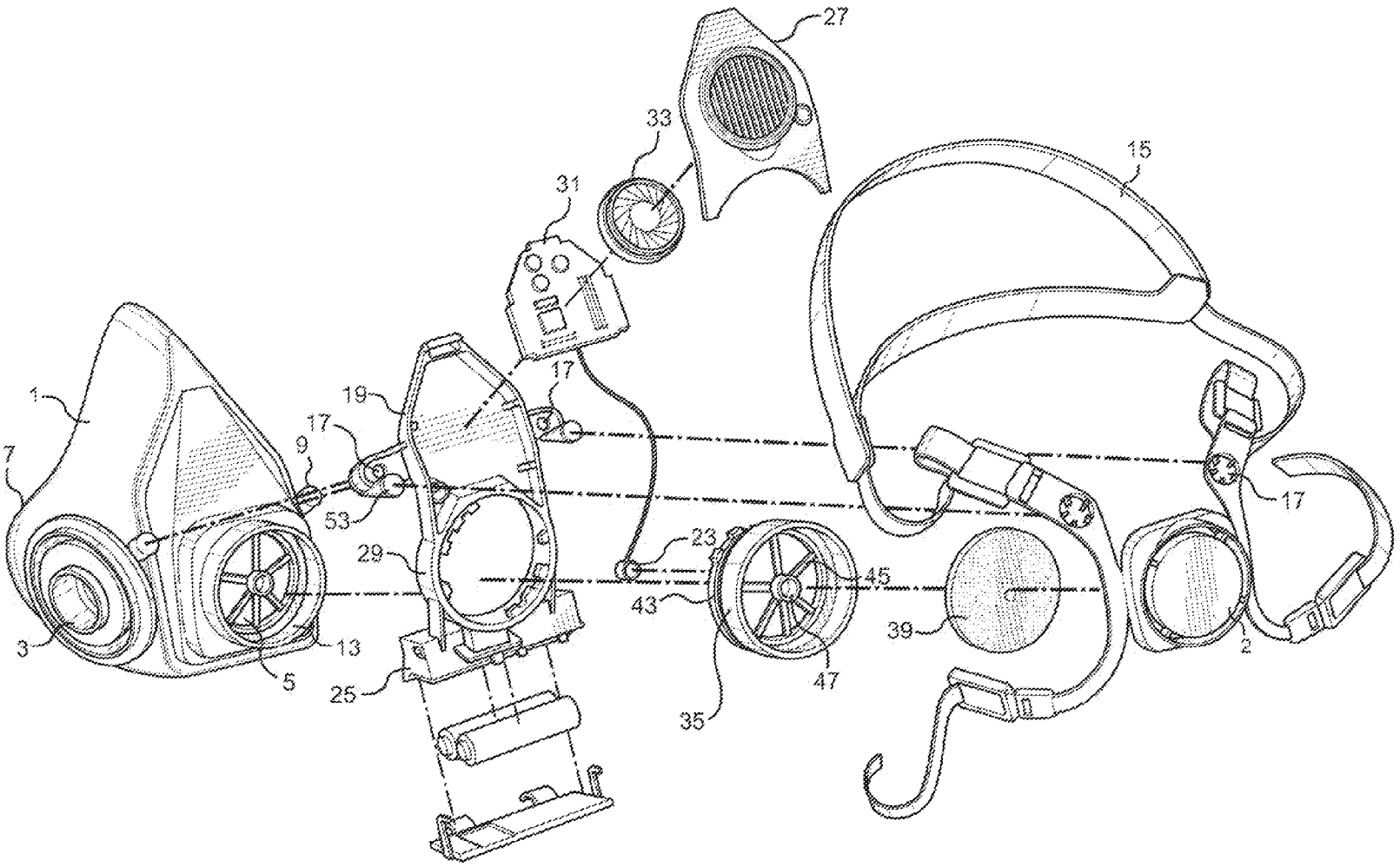
FIG. 6 shows an exploded view of one embodiment of an enhanced speech transmission device as described herein, installed on a APR.

The sealing member (37) ensures that the connection between the first portion (43) and the outlet port (5) of an APR is substantially sealed against infiltration of air from the outside environment into the clean air envelope defined by the mask and the device. The sealing member (37) may comprise one or more gaskets, o-rings, washers, grommets, molded seals, or other sealing structures, as will be appreciated by one skilled in the art. The sealing member (37) may be made of any material capable of cooperating with another material to form a substantially airtight seal, including plastic, rubber, elastomers, metal, overmolded metal, and other materials that will be apparent to one skilled in the art. In a preferred embodiment, as shown in FIGS. 4 and 6 herein, the sealing member (37) is a rubber gasket located around the outer circumference of the first portion (43) of the extension body (35) that forms a seal between the first portion (43) and the lip (13) of the outlet port (5) of an APR. Although a specific shape and material for the sealing member (37) are disclosed in the preferred embodiment hereof, it should be understood that the sealing member (37) may be any structure that cooperates with both the first portion (43) and the outlet port (5) of an APR to form a detachable sealed connection. Accordingly, a variety of seal types, structures, shapes, sizes, and materials may be used for the sealing member (37) within the scope and spirit of this invention. Further, the sealing member (37) may be integral to one or more of the first portion (43) or outlet port (5) of an APR.

The extension body (35) further comprises a second portion (45) that may include a valve portion (39). The second portion (45) may comprise an integral valve portion, or it may be shaped to connect to a removable valve portion, including specifically a valve portion (39) that comprises a valve (11) removed from an APR. In the preferred embodiment shown in FIGS. 3, 4, and 6, the second portion (45) comprises a spoke-and-hub structure that corresponds to the spoke-and-hub structure in the outlet port (5) of an APR with which the device is, in that embodiment, intended to be used. The second portion includes a central hub (47). A hole in the hub (47) is sized to receive and retain the stem (49) of a valve (11) removed from the APR, and the second portion (45) is sized and shaped to be sealed substantially in one direction by a valve (11) removed from the APR in generally the same fashion as the outlet port (5) of an APR was sealed by that same valve (11). It will, however, be appreciated by one skilled in the art that other sizes, shapes, and configurations may be used for the second portion (45) within the scope and spirit of this invention, so long as the second portion (45) includes (whether integrally or by coupling) a valve portion (39) that substantially permits air exhaled by the wearer to escape the clean air envelope and prohibits significant volumes of air from the outside environment from entering the clean air envelope defined by the APR and the device.

The valve portion (39) is a one-way valve structure that allows air exhaled by the wearer to escape from the clean air envelope without allowing significant volumes of air from the outside environment to enter the clean air envelope defined by the APR and the device, particularly when the wearer inhales. The valve portion (39) may be of virtually any size or shape, so long as it cooperates with the second portion (45) to substantially permit air exhaled by the wearer to escape from the clean air envelope and prohibit any significant volumes of air from the outside environment from entering the clean air envelope defined by the APR and the device. Preferably, the second portion (45) and valve portion (39) will cooperate to prohibit air from the outside environment from entering the clean air envelope at any rate exceeding 30 milliliters per minute at a suction pressure of 25 $mmH_2O$. Most preferably, the second portion (45) comprises a structure corresponding to the valve retention structure of the outlet port (5) of the APR with which the device is intended to be used, and the valve portion (39) comprises a valve (11) removed from that APR.

The valve portion (39) may comprise one or more valves or valve assemblies shaped to couple to said second portion (45) or one or more valve membranes shaped to couple to said second portion (45). A membrane comprising a valve portion, in whole or in part, may be made of a variety of air-impermeable materials, including natural rubber, silicone rubber, or neoprene. The valve portion (39) may comprise virtually any style of exhalation valve used on a commercially available APR, including mushroom-style valves and their membranes sheet-style valves and their membranes. In the preferred embodiment shown in FIGS. 3 and 4, the valve portion (39) is a mushroom-style valve membrane (11) removed from the outlet port (5) of an APR and reinserted by its stem (49) into a hub (47) located on the second portion (45).

The extension body (35) further comprises an aperture (41). The aperture (41) is a void passing through a portion of the wall of the extension body (35) between the sealing member (37) and the valve portion (39), such that the aperture is located within the clean air envelope but does not substantially interfere with the sealed removable connection between the extension body first portion (43) and the outlet port (5) of an APR. The aperture (41) can be of any size or shape, but is preferably sized to accommodate electrical connections, preferably insulated wires, running from a microphone (23) to the amplifier assembly (21). In the preferred embodiment, shown in FIGS. 3 and 4, the aperture (41) is located at the top of the extension body (35). Preferably, the aperture (41) is sealed around the electrical connections to prohibit excessive leakage of air from the outside environment to within the clean air envelope.

The device further comprises an amplifier assembly. The amplifier assembly comprises one or more amplifier circuit boards (31). As will be appreciated by one skilled in the art, the amplifier circuit board (31) includes capacitors, resistors and other electrical components which cooperate to filter and amplify the signal received from the microphone (23). The one or more amplifier circuit boards (31) provide an amplified signal to one or more speakers (33), as will be appreciated by one skilled in the art. The amplifier circuit board (31) is operatively connected to a power source through the battery housing portion (25), and is further operatively connected to the microphone (23). In the preferred embodiment shown in FIGS. 3 and 4, one amplifier circuit board (31) and one speaker (33) are contained within the amplifier housing portion (27). In this preferred embodiment, the amplifier circuit board (31) is operatively connected to two AAA-sized alkaline batteries located in the battery housing portion (25) by insulated wires, is further operatively connected to one speaker (33) located within the amplifier housing portion (27) by insulated wires, and is operatively connected to a microphone (23) located within the outlet port portion (29) by insulated wires running through the aperture (41), so that sound signals picked up by the microphone (23) are carried to the amplifier circuit board (31), are there filtered and amplified, and are projected in filtered and amplified form by a speaker (33) through a vent or grill in the amplifier housing portion (27). It will be understood by one skilled in the art that a large variety of amplifier circuit board types and speaker types may be used within the scope and spirit of this invention. It will further be understood that while the speaker is preferably located within the amplifier housing portion, one or more speakers may within the scope and spirit of this invention be located outside of the amplifier housing portion. Further, multiple amplifier circuit boards, or multiple speakers, or both, may be used within the scope and spirit of this invention.

The device further comprises a microphone (23) located within the outlet port portion (29). Virtually any size, shape, and style of microphone may be used, provided the microphone (23) fits within the outlet port portion (29) and can be powered by one or more of the amplifier assembly or directly by a power source connected to the battery housing portion (25). The microphone (23) is operatively connected to the amplifier assembly, preferably by insulated wires running through the aperture (41). The microphone (23) may be powered by the amplifier assembly (21) or may optionally be directly operatively connected to a power source through the battery housing portion (25). In the preferred embodiment shown in FIGS. 3 and 4, the microphone (23) is a button-type microphone seated in and secured by a fitted socket located on the interior face of the second portion (45) of the extension body (35). As will be appreciated by one skilled in the art, the microphone (23) may be located in virtually any location within the clean air envelope defined by the outlet port portion (29) and may be secured to the outlet port portion (29) by a variety of mechanical or chemical connection means, such as sockets, screws, brackets, staples, ledges, interference fits, or glues.

Figure 5:
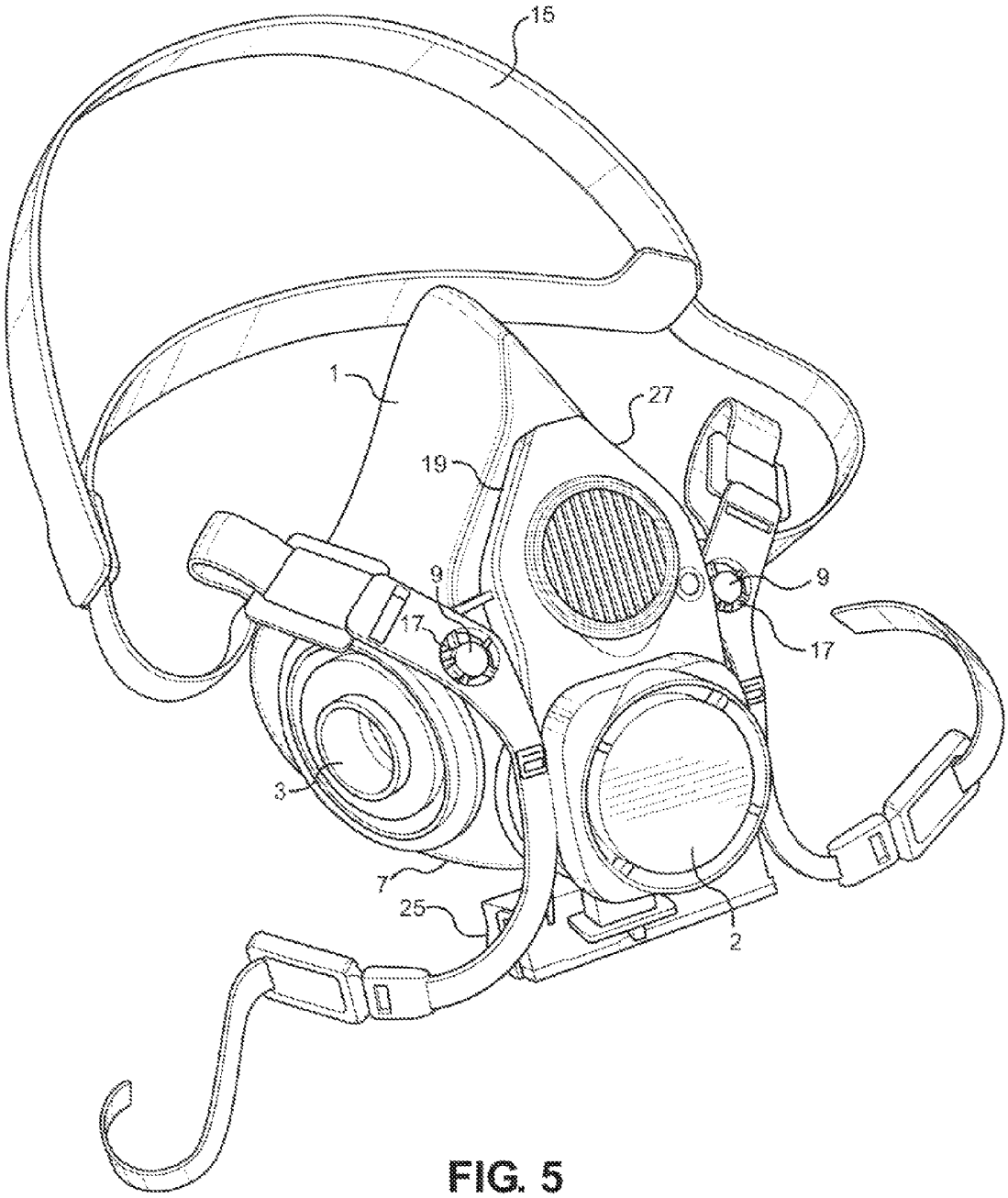
FIG. 5 shows a perspective view of one embodiment of an enhanced speech transmission device as described herein, installed on a APR.

Optionally, as shown in the preferred embodiment in FIGS. 5 and 6, the main housing (19) may further comprise APR attachment points (17) configured to attach to APR attachment pins (9). In this preferred embodiment, an attachment point (17) is disposed on either side of the amplifier housing portion (27). When said attachment points (17) are coupled to the attachment pins (9) of an APR, they assist with holding the device in place on the APR, and specifically assist with maintaining a sealed connection between said outlet port portion (29) and the outlet port (5) of an APR. Further optionally, the main housing (19) may additionally comprise substitute attachment pins (53) for connection to a retaining member (15). In the preferred embodiment shown in FIGS. 5 and 6, the substitute attachment pins (53) are coupled to the APR attachment points of a retaining member (15). The retaining member (15) optionally provides additional assistance and support in holding the APR in place on the wearer's face and in maintaining a sealed connection between said first portion (43) of said extension body (35) and the outlet port (5) of an APR.

As will be appreciated by one skilled in the art, embodiments of the present device may be configured to be certified for intrinsic safety. Other embodiments of the present device may be configured to not be certified for intrinsic safety.

Although the present invention has been described in considerable detail with reference to certain preferred versions thereof, other versions are possible. For example, other mask types, outlet port shapes, sealing member configurations, valve types, housing configurations, microphone types, speaker types, power sources, or amplification means than those disclosed herein may be used within the spirit and scope of this invention.

What is claimed is:

1. An enhanced speech transmission device for removable attachment to an APR comprising a main housing, an amplifier assembly, a speaker, and a microphone;

wherein said main housing comprises a battery housing portion, an amplifier housing portion, and an outlet port portion, said battery housing portion comprises one or more positive connectors operatively connected to the positive terminal of an electrical power source and one or more negative connectors operatively connected to the negative terminal of an electrical power source, said amplifier housing portion is shaped to contain an amplifier assembly, and said outlet port portion comprises an extension body, a sealing member, and a valve portion;

wherein a first portion of said extension body couples to the outlet port of an APR and a second portion of said extension body is connected to a valve portion, said sealing member cooperates with said first portion and said outlet port of an APR to substantially seal the connection between said first portion and said outlet port of an APR, said valve portion permits air to move from inside of the wearer's clean air envelope to the outside environment and substantially prevents air from the outside environment from entering the wearer's clean air envelope when said valve portion is connected to said second portion;

wherein said amplifier assembly comprises at least one amplifier circuit board located within said amplifier housing portion and is operatively connected to at least one of said positive connectors, at least one of said negative connectors, a microphone, and at least one speaker;

and wherein said microphone is located within the portion of the wearer's clean air envelope defined by said extension body, and said microphone is operatively connected to said amplifier assembly by one or more electrical connectors.

2. The enhanced speech transmission device for removable attachment to an APR of claim 1, further comprising an on/off switch operatively connected to said amplifier assembly.

3. The enhanced speech transmission device for removable attachment to an APR of claim 1, wherein said sealing member comprises a flexible gasket around the external circumference of said first portion of said extension body, said extension body further comprises an aperture, said aperture is located on said extension body between said sealing member and said valve portion, and said, one or more electrical connectors operatively connecting said microphone to said amplifier assembly run through said aperture.

4. The enhanced speech transmission device for removable attachment to an APR of claim 3, wherein said first portion of the extension body is coupled to the outlet port of an APR from which an APR outlet valve membrane has been removed.

5. The enhanced speech transmission device for removable attachment to an APR of claim 4, wherein said first portion is coupled to said outlet port of an APR by pressing said first portion into said outlet port of an APR at least until said sealing member substantially engages said outlet port of an APR.

6. The enhanced speech transmission device for removable attachment to an APR of claim 4, wherein said main housing further comprises one or more APR attachment points.

7. The enhanced speech transmission device for removable attachment to an APR of claim 6, wherein said main housing further comprises one or more substitute APR attachment pins.

8. The enhanced speech transmission device for removable attachment to an APR of claim 3, wherein said valve portion comprises a valve membrane.

9. An enhanced speech transmission APR comprising:

(a) an APR, wherein the APR outlet valve membrane has been removed from the outlet port of the APR and said outlet port of the APR is sealably and removably connected to an enhanced speech transmission device;

(b) said enhanced speech transmission device comprises a main housing, an amplifier assembly, a microphone, and a speaker, said main housing comprises a battery housing portion, an amplifier housing portion, and an outlet port portion, said battery housing portion comprises one or more positive connectors operatively connected to the positive terminal of a battery and one or more negative connectors operatively connected to the negative terminal of a battery, said amplifier housing portion contains an amplifier assembly, and said outlet port portion comprises an extension body, a sealing member, and a valve portion;

wherein a first portion of said extension body couples to the outlet port of an APR and a second portion of said extension body is connected to a valve portion, said sealing member cooperates with said first portion and said outlet port of an APR to substantially seal the connection between said first portion and said outlet port of an APR, and said valve portion permits air to move from inside of the wearer's clean air envelope to the outside environment and substantially prevents air from the outside environment from entering the wearer's clean air envelope when said valve portion is connected to said second portion;

wherein said amplifier assembly comprises one or more amplifier circuit boards located within said amplifier housing portion and said amplifier assembly is operatively connected to at least one of said positive connectors, at least one of said negative connectors, at least one microphone, and at least one speaker;

and wherein said microphone is located within a portion of the wearer's clean air envelope defined by said extension body and is operatively connected to said amplifier assembly by electrical connectors.

10. The enhanced speech transmission APR of claim 9, further comprising an on/off switch operatively connected to said amplifier assembly.

11. The enhanced speech transmission APR of claim 9, wherein said sealing member comprises a flexible gasket around the circumference of the first portion of said extension body, said extension body further comprises an aperture, said aperture is located on said extension body between said sealing member and said valve portion, and said, one or more electrical connectors operatively connecting said microphone to said amplifier assembly run through said aperture.

12. The enhanced speech transmission APR of claim 11, wherein said first portion of the extension body forms a sealed connection with the outlet port of an APR from which the APR outlet valve membrane has been removed.

13. The enhanced speech transmission APR of claim 12, wherein said first portion is coupled to said outlet port of an APR by pressing said first portion into said outlet port of an APR at least until said sealing member substantially engages said outlet port of an APR.

14. The enhanced speech transmission APR of claim 11, wherein said valve portion comprises a valve membrane.

15. The enhanced speech transmission APR of claim 11, wherein said main housing further comprises one or more APR attachment points.

16. The enhanced speech transmission device APR of claim 15, wherein said main housing further comprises one or more substitute APR attachment pins.

17. A method for enhancing the speech of a user wearing an APR, said method comprising the steps of:

(a) providing an APR;

(b) removing the outlet valve from the outlet port of said APR;

(c) preparing for use a device for enhanced speech transmission, said device comprising a main housing, an amplifier assembly, and a microphone, wherein said main housing comprises an amplifier housing portion, a battery housing portion, and an outlet port portion, said battery housing portion comprises one or more positive connectors operatively connected to the positive terminal of a battery and one or more negative connectors operatively connected to the negative terminal of a battery, said amplifier housing portion contains an amplifier assembly, and said outlet port portion comprises an extension body, a sealing member, a valve portion, and an aperture;

wherein a first portion of said extension body couples to the outlet port of an APR and a second portion of said extension body is connected to a valve portion, said sealing member cooperates with said first portion and said outlet port of an APR to substantially seal the connection between said first portion and said outlet port of an APR, said valve portion comprises a one-way valve, and said aperture is located on said extension body between the said sealing member and said valve portion;

wherein said device further comprises an amplifier assembly located within said amplifier housing portion, said amplifier assembly comprises at least one amplifier circuit board, and said amplifier assembly is operatively connected to at least one of said positive connectors, at least one of said negative connectors, at least one microphone, and at least one speaker;

said device further comprises a microphone located within a portion of the wearer's clean air envelope defined by said extension body, said microphone operatively connected to said amplifier assembly by one or more electrical connectors such that said one or more electrical connectors run through said aperture;

(d) coupling said device for enhanced speech transmission to said outlet port of an APR;

(e) said user wearing said APR; and (f) said user speaking while wearing said APR.

18. The method of claim 17, wherein said device further comprises an on/off switch operatively connected to said amplifier assembly and said method further includes the step of switching said device on.

19. The method of claim 17, wherein said sealing member comprises a flexible gasket disposed around the circumference of said extension body.

20. The method of claim 17, wherein said outlet valve located in the outlet port of an APR is a valve membrane, and said step of removing said outlet valve from the outlet port of said APR comprises removing said valve membrane from said outlet port of an APR.

21. The method of claim 20, wherein said step of preparing for use a device further comprises coupling said valve membrane to said second portion to form a valve portion.

22. The method of claim 17, wherein said main housing further comprises one or more APR attachment points adapted to receive one or more APR attachment pins.

23. The method of claim 22, wherein said main housing further comprises one or more substitute APR attachment pins.

* * * * *